US009732937B2

(12) United States Patent
Wang et al.

(10) Patent No.: US 9,732,937 B2
(45) Date of Patent: Aug. 15, 2017

(54) ILLUMINATION OPTICAL SYSTEM WITH TUNABLE BEAM ANGLE

(71) Applicants: Zhuo Wang, Middleton, MA (US); Bruce Radl, Stow, MA (US)

(72) Inventors: Zhuo Wang, Middleton, MA (US); Bruce Radl, Stow, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 84 days.

(21) Appl. No.: 14/836,100

(22) Filed: Aug. 26, 2015

(65) Prior Publication Data

US 2016/0091176 A1 Mar. 31, 2016

Related U.S. Application Data

(60) Provisional application No. 62/057,623, filed on Sep. 30, 2014.

(51) Int. Cl.

| | |
|---|---|
| ***F21V 7/00*** | (2006.01) |
| ***F21V 13/12*** | (2006.01) |
| ***F21V 14/04*** | (2006.01) |
| *F21V 7/04* | (2006.01) |
| *F21V 7/22* | (2006.01) |

(Continued)

(52) U.S. Cl.

CPC ..... *F21V 7/0091* (2013.01); *F21V 7/0008* (2013.01); *F21V 7/043* (2013.01); *F21V 13/12* (2013.01); *F21V 14/04* (2013.01); *F21S 6/00* (2013.01); *F21V 7/0033* (2013.01);

(Continued)

(58) Field of Classification Search

CPC ..... F21S 6/003; F21S 8/088; F21S 48/1341; F21S 48/1376; F21S 48/1388; F21V 7/049; F21V 7/0008; F21V 7/06; F21V 7/043; F21V 7/09; F21V 13/04; F21W 2131/10

See application file for complete search history.

(56) References Cited

U.S. PATENT DOCUMENTS 5,134,550 A * 7/1992 Young ..... F21S 8/088 362/298
6,726,350 B1 * 4/2004 Herold ..... F21L 4/027 362/240

(Continued)

FOREIGN PATENT DOCUMENTS

| | | |
|---|---|---|
| DE | 697 15 918 T2 | 6/2003 |
| DE | 203 11 061 U1 | 12/2003 |
| WO | 2014/120245 A1 | 8/2014 |

*Primary Examiner* — Hargobind S Sawhney
(74) *Attorney, Agent, or Firm* — Shaun P. Montana

(57) ABSTRACT

An illumination optical system with a tunable beam angle (IOSTBA) is presented to achieve different beam angles without changing parts. The IOSTBA includes a light source and a post having a proximal end and a distal end, the proximal end in optical communication with the light source, an internal area of the post having a reflective surface. Also shown is a diffuser disposed across the end of the post, the diffuser in optical communication with the post and a reflector surrounding a portion of the post, the reflector movable along a length of the post. A position of the reflector along the post determines a beam angle of a resulting light beam exiting the IOSTBA. The system features a simple and cost effective optical design which works with a variety of light sources, including color mixing and champing strategies.

16 Claims, 9 Drawing Sheets

(51) Int. Cl.
*F21Y 115/10* (2016.01)
*F21S 6/00* (2006.01)

(52) U.S. Cl.
CPC ..... *F21V 7/041* (2013.01); *F21V 7/048* (2013.01); *F21V 7/22* (2013.01); *F21Y 2115/10* (2016.08)

(56) References Cited

U.S. PATENT DOCUMENTS 7,425,084 B2 * 9/2008 Ruud ..... F21S 8/083 362/245
2012/0321290 A1 12/2012 Daijo

* cited by examiner

ILLUMINATION OPTICAL SYSTEM WITH TUNABLE BEAM ANGLE

CROSS-REFERENCE TO RELATED APPLICATION

The present application is a nonprovisional of, and claims priority to, U.S. Provisional Application No. 62/057,623, entitled "ILLUMINATION OPTICAL SYSTEM WITH TUNABLE BEAM ANGLE" and filed Sep. 30, 2014, the entire contents of which are hereby incorporated by reference.

TECHNICAL FIELD

The present invention relates to lighting, and more specifically, to lighting devices including one or more solid state light sources.

BACKGROUND

In the area of downlight lighting products, depending on the application, customers can choose different beam patterns. These different beam patterns range from NSP (narrow spot light, 8-15 degrees), SP (spot light, 8-20 degrees), NFL (narrow flood light, 24-30 degrees), FL (flood, 35-40 degrees), WFL (wide flood, 55 to 60 degrees) and VWFL (very wide flood, 60 degrees or more). A typical lighting system includes a light source such as one or more solid state light sources. The light produced by the light source is diffused by a diffuser which also provides the beam pattern. Different diffusers provide different beam patterns for a similar light source.

SUMMARY

Conventional lighting systems, such as those explained above, suffer from a variety of deficiencies. One such deficiency is that, while customers can buy a Parabolic Aluminized Reflector (PAR) 30 lamp with a particular beam angle that ranges from NSP all the way to VWFL, often, users may need a different beam angle after the lamp is installed. This, however, can only be done by changing the whole lamp, or at the very least changing the diffuser. However, changing the diffuser may not be possible, or convenient, resulting in the whole lamp still needing to be changed. Alternately, the lamp could be provided with a focusing system, similar to a camera, however this is expensive to implement.

Embodiments significantly overcome such deficiencies and provide an illumination optical system that is capable of achieving different beam angles without changing any parts of the illumination optical system. The illumination optical system features a simple and cost effective optical design that works with any type of light source, particularly one or more solid state light sources. Embodiments work well with color mixing and champing strategies. Due to their manufacturing process, including the epitaxial growth and phosphor coating, solid state light sources such as LEDs are typically binned for brightness (lumens) and color (chromacity). Unlike traditional lighting, color mixing of LEDs can help multi-LED products take the best advantage of LED performance and provide color tunability. LED champing (systematic blending of LEDs of various tints to achieve one consistent color) also allows the use of a large chromacity range while reducing LED unit costs. LED color mixing and champing techniques achieve consistent, repeatable multi-LED lighting. Of course, the above applies to other solid state light sources as well, such as but not limited to organic LEDs (OLEDs), polymer LEDs (PLEDs), organic light emitting compounds (OLECs), and the like.

In an embodiment, there is provided an optical system. The optical system includes a light source; a post having a proximal end and a distal end, the proximal end in optical communication with the light source, an internal area of the post having a reflective surface; a diffuser disposed across the distal end of the post, the diffuser in optical communication with the post; and a reflector surrounding a portion of the post, the reflector movable along a length of the post, wherein a position of the reflector along the post determines a beam angle of a resulting light beam exiting the optical system.

In a related embodiment, the reflector may include a smooth parabolic reflector. In another related embodiment, the reflector may be faceted. In yet another related embodiment, the reflector may be specular. In still another related embodiment, the reflector may be Lambertian. In yet still another related embodiment, the reflector may be between specular and Lambertian.

In still another related embodiment, the resulting light beam may be one of the group comprising a Narrow SPot beam (NSP), a SPot light (SP), a Narrow Flood Light (NFL), a FLood (FL), a Wide FLood (WFL), and a Very Wide FLood (VWFL).

In yet another related embodiment, the post may be comprised of specular material. In still another related embodiment, the post may be comprised of diffusive material. In yet still another related embodiment, the post may be comprised of solid material. In still yet another related embodiment, the post may be liquid filled. In yet still another related embodiment, the diffuser may include a cone reflector. In still yet another related embodiment, the reflector may include different zonal properties.

In yet still another related embodiment, the post may include grooves on the side of the post so that light may be guided within the post due to two or more total internal reflection (TIR) reflections.

In still yet another related embodiment, the diffuser may have one of the group comprising a flat shape and a curved shape. In yet still another related embodiment, the reflector may include one of the group comprising a plain reflector, a transparent solid having a reflective coating and a transparent solid having as grooved structure.

In another embodiment, there is provided an optical system. The optical system includes: a post having a proximal end and a distal end; a light source disposed on the proximal end of the post; wherein the post is movable in a generally vertical position, wherein a position of the post determines a beam angle of a resulting light beam exiting the optical system.

In another embodiment, there is provided an illumination optical system. The illumination optical system includes: a light source; a post having a proximal end and a distal end, the proximal end in optical communication with the light source, an internal area of the post having a reflective surface; a diffuser disposed across the distal end of the post, the diffuser in optical communication with the post; and a reflector surrounding an upper portion of the post, the reflector compressible between a first position and a second position, wherein an amount of compression of the reflector determines a beam angle of a resulting light beam exiting the optical system.

In a related embodiment, the reflector may be comprised of multiple sections.

The features of the invention, as explained herein, may be employed in lighting devices and/or systems such as those manufactured by OSRAM SYLVANIA Inc. of Danvers, Mass.

Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Traditionally, e.g. for conventional PAR lamps, a reflector is designed that can satisfy the tightest beam angle requirement, say NSP, and then different diffusers (or a lenticular lens) are placed in front of the designed reflector to achieve all other beam angles. The reflector can be smooth, parabolic, or faceted. The reflection can be specular (high gloss surface with low diffuseness, mirror) or Lambertian (completely diffuse) or anywhere in between. Specular reflection is the mirror-like reflection of light from a surface, in which light from a single incoming direction is reflected into a single outgoing direction. Lambertian reflectance is the property that defines a diffusely reflecting surface. The apparent brightness of such a surface to an observer is the same regardless of the observer's angle of view. As discussed above, in order to get a different beam angle, users have to change the whole lamp, or may have to change the diffusers, which is hard to do because often the diffuser is glued to the reflector as a whole.

One alternative to conventional lighting systems is to use a zoom lens system in front of the light source. While there is no need to change the diffuser for this case, the cost of such a zoom lens system will be an issue for such kind of systems to be adapted by many applications. All the aforementioned issues, as shown below, are addressed by embodiments disclosed herein.

Figure 1A:
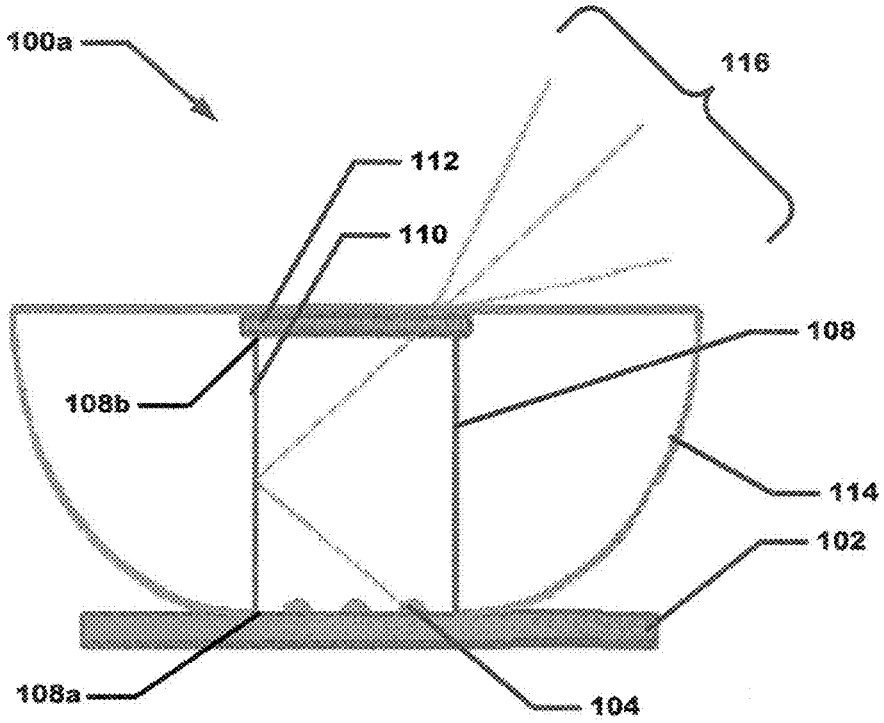
FIG. 1A depicts a cut-away side view of an illumination optical system with a tunable beam angle at a first position according to embodiments disclosed herein.

Compared to the traditional way to achieve tunable beam angles by changing the diffusers, embodiments described herein do not require any changeable parts and thus are preferred for many applications. Though the prior art applications are discussed in terms of lamps, embodiments are not so limited and may be used in any type of lighting device, such as but not limited to lamps, light engines, modules, fixtures, luminaires, systems, and so forth. An embodiment of an illumination optical system with tunable beam angle (IOSTBA) 100*a* is shown in FIG. 1A. It includes a substrate 102 (such as but not limited to a printed circuit board, metal core circuit board, flexible polymer, etc.) having a light source 104 disposed thereon. The light source 104, in some embodiments, is one or more solid state light sources mounted thereon. In some embodiments, individual solid state light sources are used. A post 108 has a proximal end 108*a* and a distal end 108*b*, the proximal end 108*a* in optical communication with the light source 104. An internal area of the post has a reflective surface 110. In some embodiments, the post 108 includes specular reflection film (98% reflectivity) to create a better light recycling chamber. The post 108, in some embodiments, is a hollow tube having a reflective surface on an internal portion thereof. Alternately, in some embodiments, the post 108 is realized as a solid light guide with a reflective surface surrounding the outer portion of the post. The reflective surface can be due to total internal reflection (TIR). It is also possible, in some embodiments, to have V-grooves or other markings on the side of the post 108 so that light will be guided within the post due to two or more TIRs reflections. In some embodiments, the post 108 is filled with a fluid. The post 108 also serves as a mixing chamber for the light. The reflection can be either specular or diffusive or somewhere in between. Specular reflection favors higher optical efficiency with less mixing capabilities. Diffusive reflection has lower optical efficiency with similar reflectivity but favors better light mixing.

When used, a diffuser 112 is disposed across the distal end 108*b* of the post 108, the diffuser 112 in optical communication with the post 108. The diffuser 112 shown in FIG. 1A is a volume diffuser. Other type of diffusers could be, and in some embodiments are, used. For example, holographic diffusers or engineered diffusers with microstructures could also be used to spread light to specific directions for better controllability. In some embodiments, the diffuser is be totally flat. Thus, in some embodiments, the diffuser curves to form certain shapes. For example, if the post 108 is a solid light guide, the diffuser 112, in some embodiments, is a part of the post 108 with roughened surfaces or molded patterns for specific beam shaping purposes. Again, the diffuser 112 is formed to any desired shape or shapes. "Diffuser" is really a general word here to imply any type of beam shaping optics with refractive/reflective/scattering and even diffractive natures.

The IOSTBA 100*a* further includes a reflector 114 surrounding a portion of the post 108. The reflector 114 is movable along a length of the post 108, wherein a position of the reflector 114 along the post determines a beam angle of a light beam 116 exiting the optical system. The reflector 114, in some embodiments, is movable along the post 108 by any manner as would be known by one of ordinary skill in the art. Any type of reflector (formed reflectors, faceted reflectors, double TIR reflectors, and/or different shapes and functional reflectors) are possible for use in the IOSTBA 100*a*. In some embodiments, the reflector 114 has a central opening fitting around the post 108. The reflector 114, in some embodiments, has a highly polished and reflective surface for providing optimal reflection of light, and in other embodiments, has a more or less reflective surface depending on the amount and type of reflection desired. In some embodiments, the reflector 114 has a parabolic shape, though reflectors having different shapes are also possible. The reflector 114 is movable in a vertical (and horizontal) direction about the post 108, and movement of the reflector 114 along the post 108 provides different size light beams, as explained in detail below. Accordingly, the same illumination optical system provides a tunable beam angle and can be used in a variety of applications.

In some embodiments, the reflector 114 is designed with different zonal properties so that different beam angles are obtained. For example, in some embodiments, a cone reflector is used to replace the diffuser. A carefully designed cone reflector will help to guide the light to a specific direction (e.g. form an extreme batwing distribution), which facilitates the reflector design for an accurate control of the beam angle. It should also be noted that color mixing and champing strategies can be used due to a highly efficient light mixing chamber formed within the post 108.

Figure 1B:
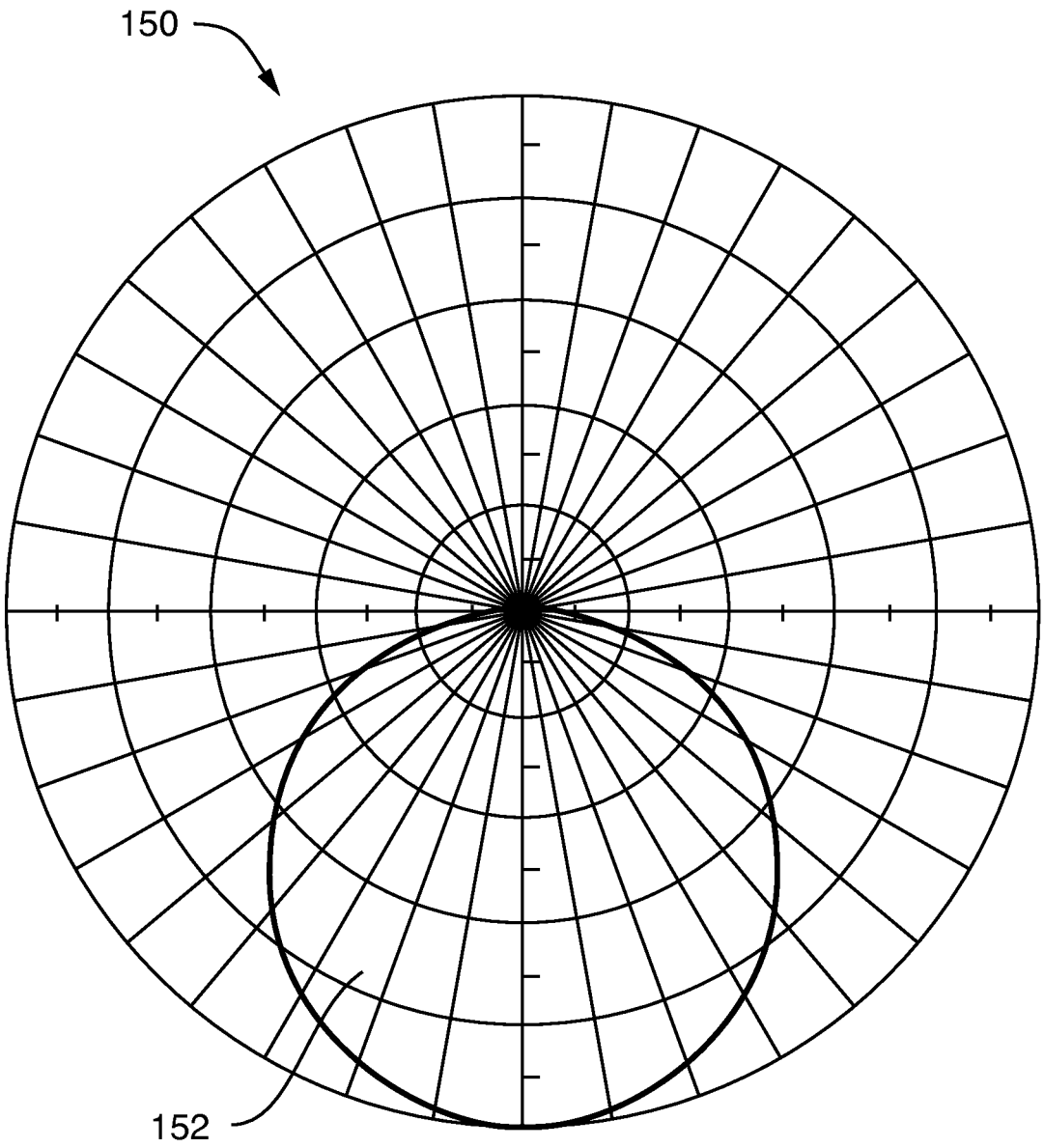
FIG. 1B shows a graph of a resulting light beam from the illumination optical system of FIG. 1A.

In the IOSTBA 100*a* shown in FIG. 1A, the reflector 114 is disposed at a lowest position on the post 108. As a result, light from the light source 104 reflects off the reflective surface 110 of the post 108 and to the diffuser 112. Light leaves the diffuser 112 and avoids interaction with the reflector 114 since the reflector 114 is at a lowest position along the post 108, resulting in a wide light beam 152, shown in a graph 150 in FIG. 1B. The resulting wide light beam 152 has a beam angle (FWHM) of approximately 120 degrees.

Figure 2A:
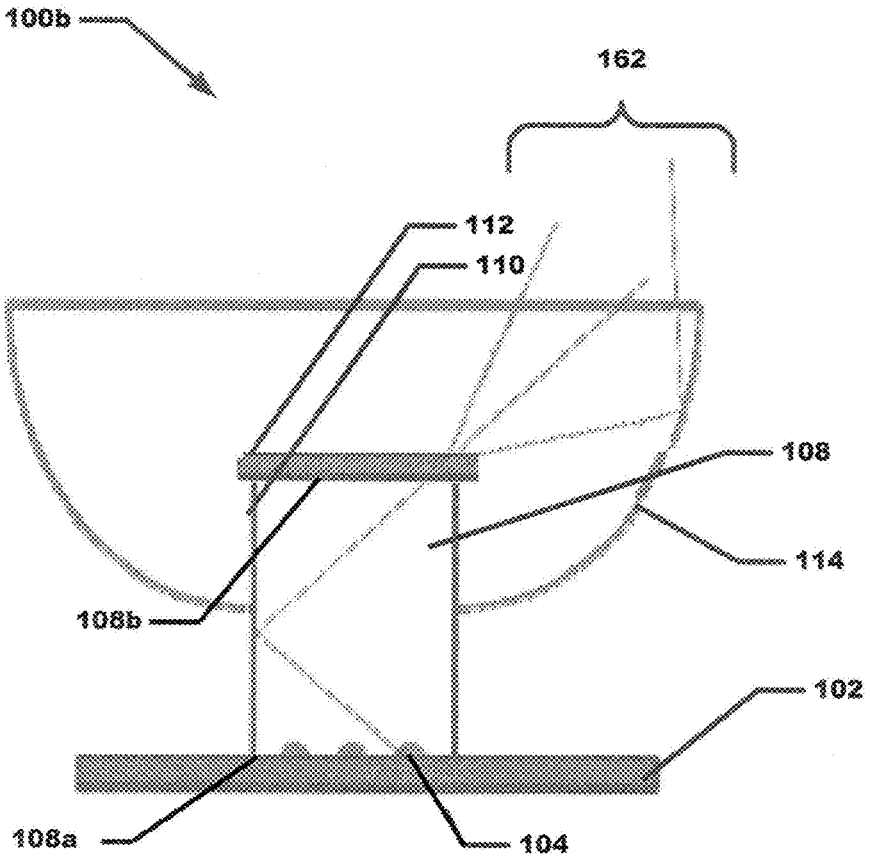
FIG. 2A depicts a cut-away side view of an illumination optical system with a tunable beam angle at a second position according to embodiments disclosed herein.

FIG. 2A shows an IOSTBA 100*b*, which includes the same components as the IOSTBA 100*a* of FIG. 1A, but here the reflector 114 is disposed at a generally middle position on the post 108. As a result, light from the light source 104 reflects off the reflective surface 110 of the post 108 and to the diffuser 112, as with the IOSTBA 100*a* of FIG. 1A. However, here in FIG. 2A, light leaves the diffuser 112 and interacts with the reflector 114, resulting in a narrower light beam 162, as shown in detail in a graph 160 of FIG. 3B. Note that the light beam 162 is narrower than the light beam 152 shown in FIG. 1B due to the position of the reflector 114 along the post 108 in the IOSTBA 100*b* of FIG. 2A. The resulting narrower light beam 162 has a beam angle of approximately 20 degrees.

Figure 2B:
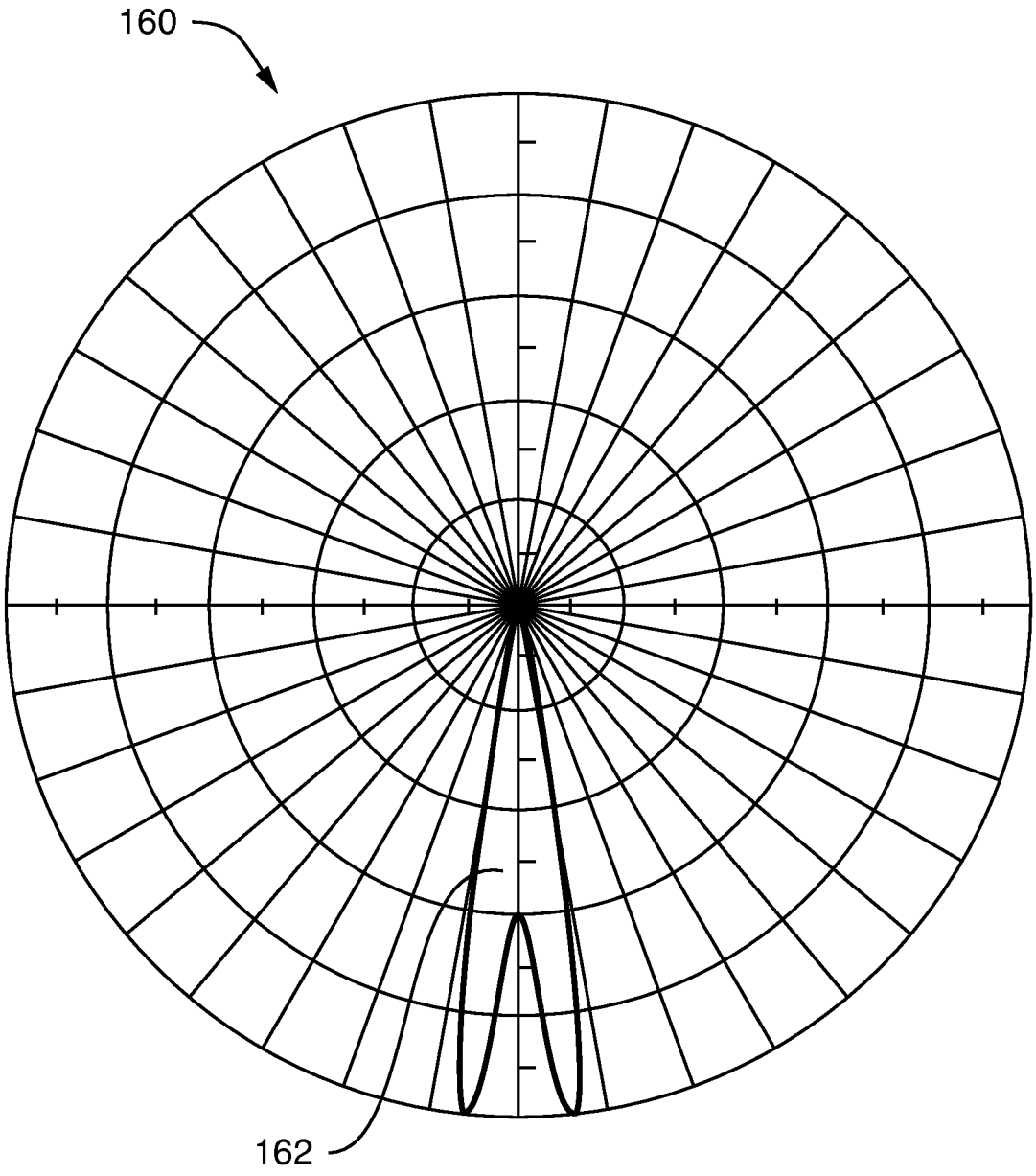
FIG. 2B shows a graph of a resulting light beam from the illumination optical system of FIG. 2A.
Figure 3A:
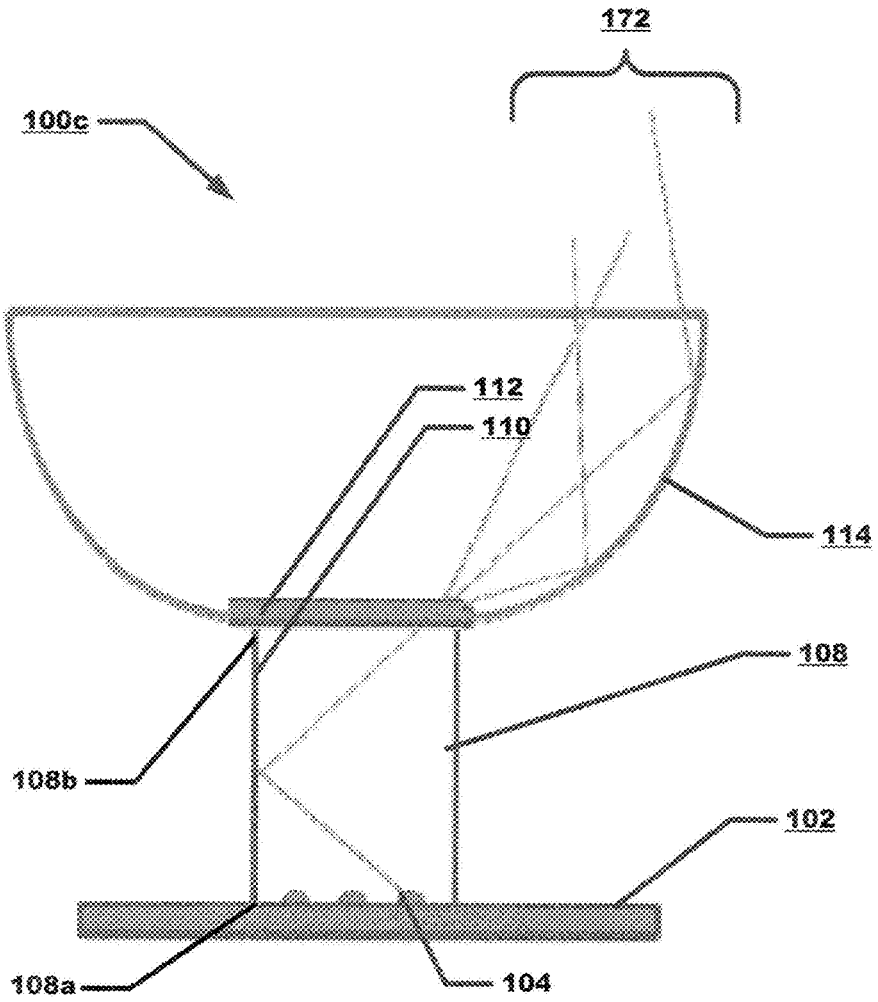
FIG. 3A depicts a cut-away side view of an illumination optical system with a tunable beam angle at a third position according to embodiments disclosed herein.
Figure 3B:
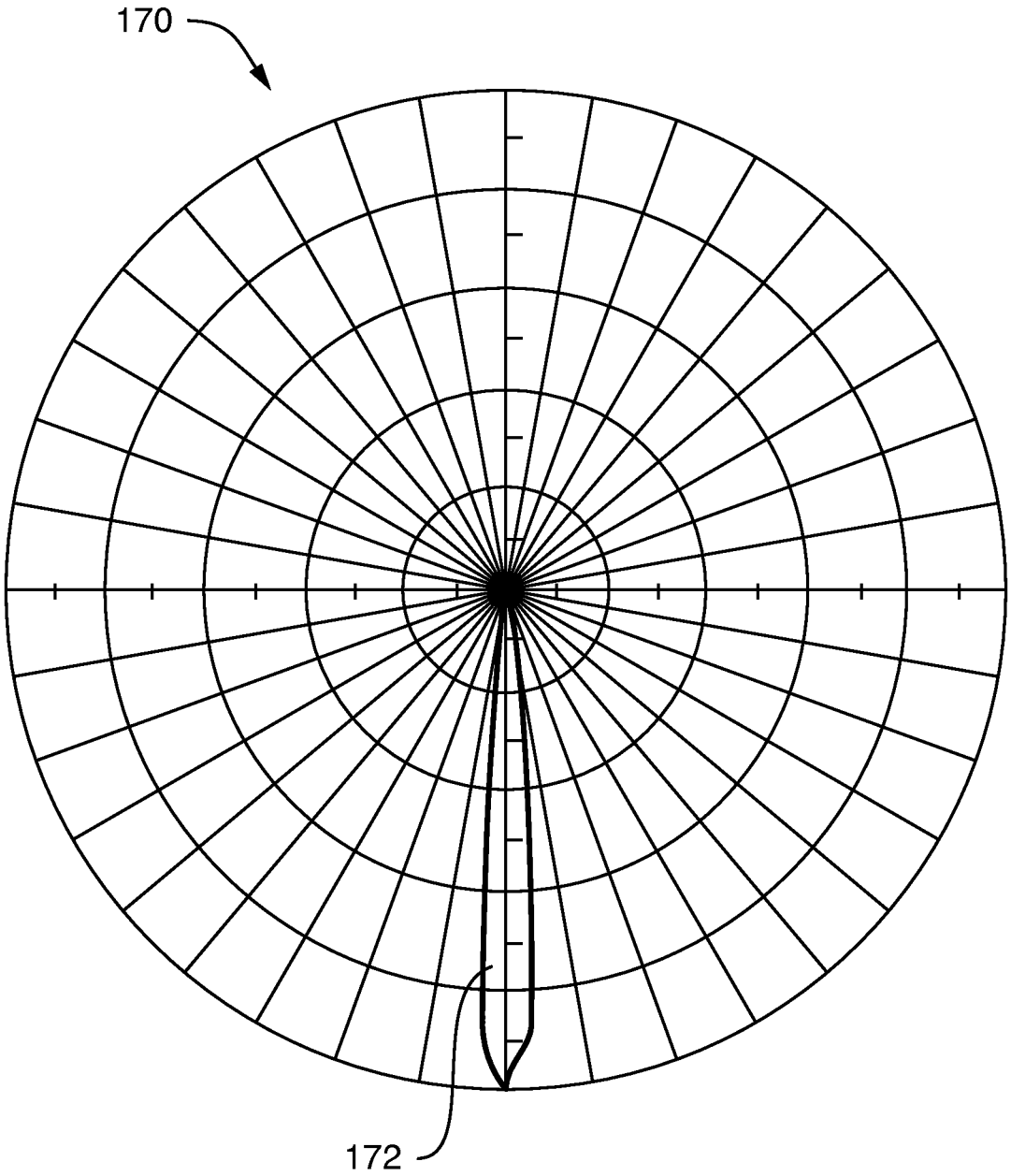
FIG. 3B shows a graph of a resulting light beam from the illumination optical system of FIG. 3A.

FIG. 3A shows an IOSTBA 100*c*, which includes the same components as the IOSTBA 100*a* of FIG. 1A and the IOSTBA 100*b* of FIG. 2A, but here the reflector 114 is disposed at a top position on the post 108. As a result, light from the light source 104 reflects off the reflective surface 110 of the post 108 and to the diffuser 112, as with the IOSTBA 100*a* of FIG. 1A and the IOSTBA 100*b* of FIG. 2A. Here, however, somewhat similarly to the IOSTBA 100*b* of FIG. 2A, light leaves the diffuser 112 and interacts with the reflector 114, resulting in a narrow light beam 172. The narrow light beam 172 is shown in detail in a graph 170 in FIG. 3B, which is narrower than the narrow light beam 162 of FIG. 2B (and also the light beam 152 of FIG. 1B) due to the position of the reflector 114 along the post 108 in the IOSTBA 100*c* of FIG. 3A. The narrow light beam 172 shown in FIG. 3B has a beam angle of approximately 10 degrees.

Figure 4:
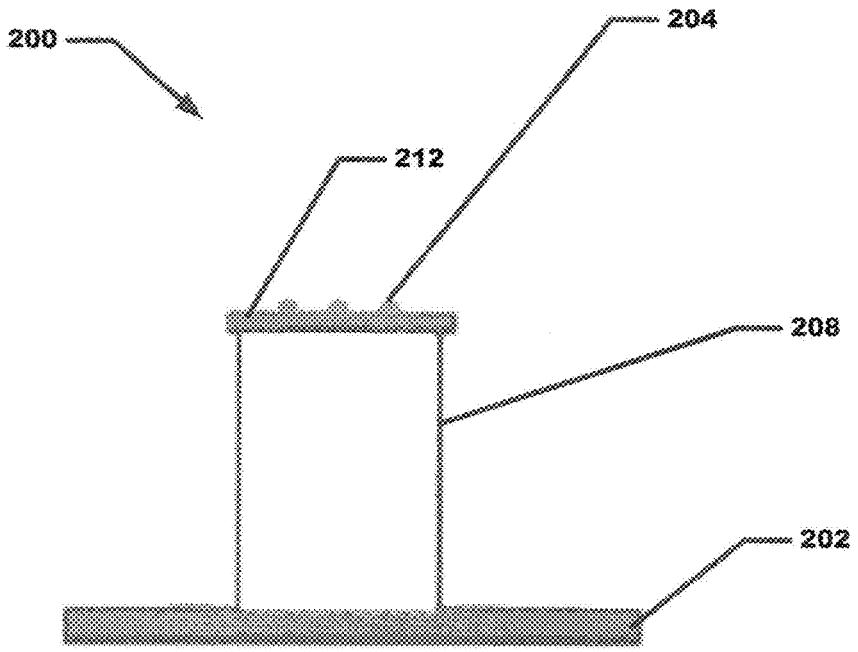
FIG. 4 is a picture of an illumination optical system with a tunable beam angle wherein the post elevates the light source according to embodiments disclosed herein.

FIG. 4 shows another embodiment of an IOSTBA 200 including a base 202, one or more light sources 204, and a post 208. In FIG. 4, the post 208 is a solid, heat conducting cylinder that elevates the one or more light sources 204 and does not use a reflector. In FIG. 4, a substrate 212, onto which the one or more light sources 204 are placed, is mounted on a top of the post 208 (that is, an end of the post 208 that is opposite the base 202). The post 208 is movable in a vertical direction to provide different heights with respect to the base 202.

Figure 5A:
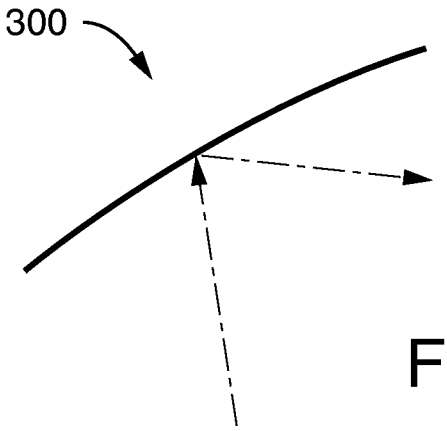
FIG. 5A is a diagram of a plain reflector according to embodiments disclosed herein.
Figure 5B:
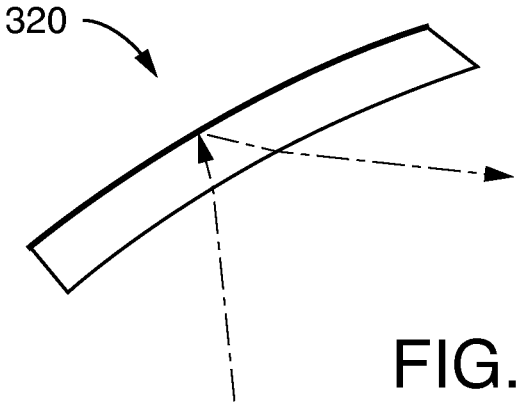
FIG. 5B is a diagram of a reflector as a transparent solid with a reflective coating according to embodiments disclosed herein.
Figure 5C:
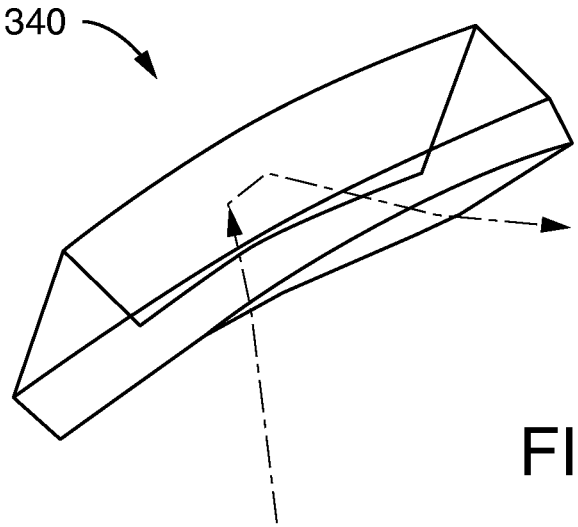
FIG. 5C is a diagram of a reflector as a transparent solid with a grooved structure according to embodiments disclosed herein.

FIGS. 5A-5C show different style reflectors. FIG. 5A shows a reflector 300 that is a plain reflector, where an incoming ray (denoted by an arrow pointed towards the reflector 300) is reflected back as a reflected ray. FIG. 5B shows a reflector 320 comprising a transparent solid having a reflective coating. FIG. 5C shows a reflector 340 comprising a transparent solid having a grooved structure. While grooves are shown and descried, it should be appreciated that other shapes could also be used. As shown in FIG. 5C, light within the grooved structure is reflected within the groove before being reflected away from the reflector surface.

Figure 6B:
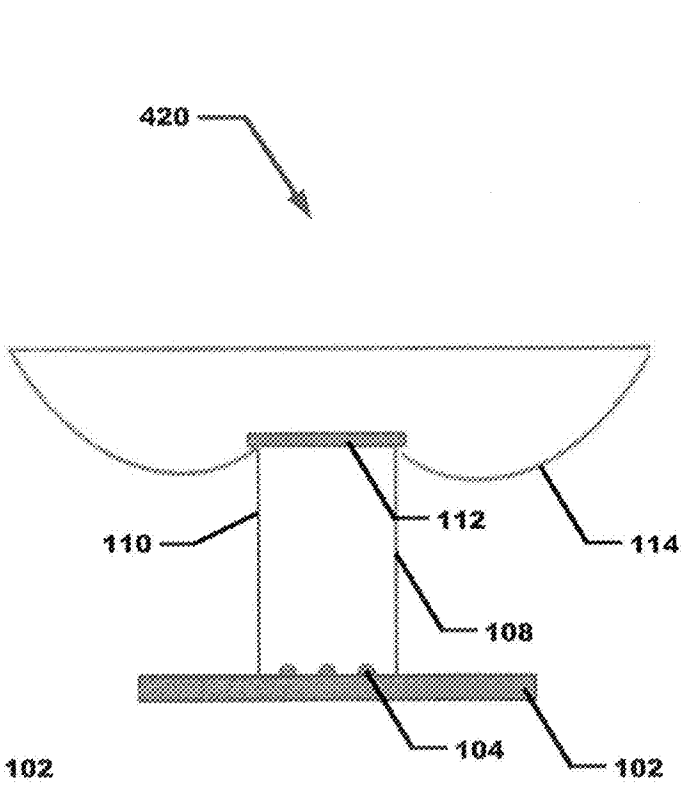
FIG. 6B depicts a cut-away side view of the illumination optical system of FIG. 6A wherein the reflector has been compressed according to embodiments disclosed herein.
Figure 6A:
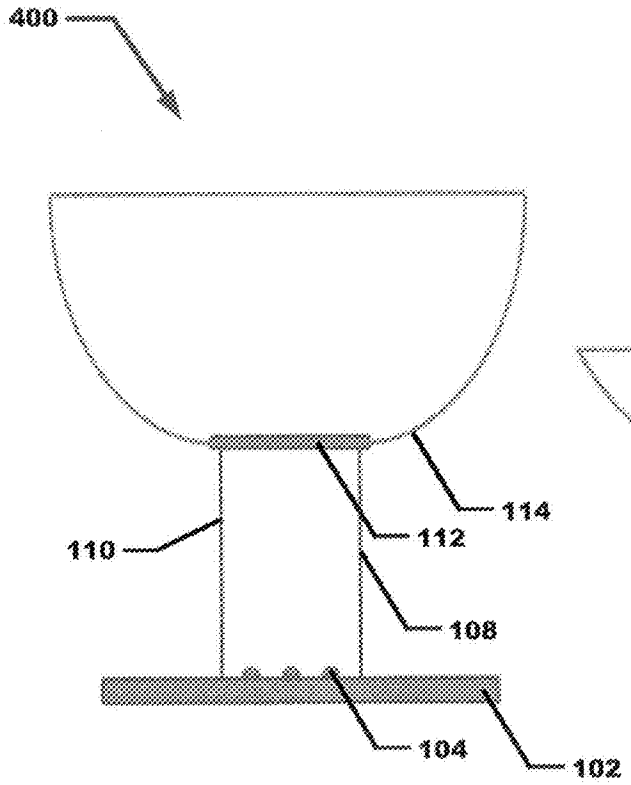
FIG. 6A depicts a cut-away side view of an illumination optical system with a tunable beam angle at a first position according to embodiments disclosed herein.

FIGS. 6A and 6B show an IOSTBA having similar components as the IOSTBA 100*a* shown in FIG. 1 that changes between a first state 400 and a second state 420. In FIGS. 6A-6B, the reflector 114 is capable of compression. Thus, FIG. 6A shows the reflector 114 in the first state 400 (uncompressed), and FIG. 6B shows the reflector 114 in the (compressed) second state 420. Though the reflector 114 shown in FIGS. 6A and 6B is a typical parabolic shape, embodiments are not so limited, and thus in some embodiments, the reflector 114 is comprised of several sections or blades, some or all of which are capable of moving between a first state and a second state.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. An optical system comprising:

a light source;

a post having a proximal end and a distal end, the proximal end in optical communication with the light source, an internal area of the post having a reflective surface, wherein the post is totally reflective;

a diffuser disposed across the distal end of the post, the diffuser in optical communication with the post; and a reflector surrounding a portion of the post, the reflector movable along a length of the post, wherein a position of the reflector along the post determines a beam angle of a resulting light beam exiting the optical system.

2. The optical system of claim 1, wherein the reflector comprises a smooth parabolic reflector.

3. The optical system of claim 1, wherein the reflector is faceted.

4. The optical system of claim 1, wherein the reflector is specular.

5. The optical system of claim 1, wherein the reflector is Lambertian.

6. The optical system of claim 1, wherein the reflector is between specular and Lambertian.

7. The optical system of claim 1, wherein the resulting light beam is one of the group comprising a Narrow SPot beam (NSP), a SPot light (SP), a Narrow Flood Light (NFL), a FLood (FL), a Wide FLood (WFL), and a Very Wide FLood (VWFL).

8. The optical system of claim 1, wherein the post is comprised of specular material.

9. The optical system of claim 1, wherein the post is comprised of diffusive material.

10. The optical system of claim 1, wherein the post is comprised of solid material.

11. The optical system of claim 1, wherein the post is liquid filled.

12. The optical system of claim 1, wherein the diffuser comprises a cone reflector.

13. The optical system of claim 1, wherein the reflector includes different zonal properties.

14. The optical system of claim 1, wherein the post includes grooves on the side of the post so that light is guided within the post due to two or more total internal reflection (TIR) reflections.

15. The optical system of claim 1, wherein the diffuser has one of the group comprising a flat shape and a curved shape.

16. The optical system of claim 1, wherein the reflector comprises one of the group comprising a plain reflector, a transparent solid having a reflective coating and a transparent solid having as grooved structure.

* * * * *